US005248101A

United States Patent [19]

Rose et al.

[11] Patent Number: 5,248,101

[45] Date of Patent: Sep. 28, 1993

[54] EFFICIENT CENTRIFUGAL IMPACT CRUSHER WITH DUST REMOVAL CAPABILITY AND METHOD OF USING SAME

[75] Inventors: Neil M. Rose, Vancouver, Wash.; Stephen B. Ackers, Portland, Oreg.; Brett M. Rose, Battle Ground; William F. Burr, Ridgefield, both of Wash.

[73] Assignee: Canica Crushers, Inc., Vancouver, Wash.

[21] Appl. No.: 881,039

[22] Filed: May 11, 1992

Related U.S. Application Data

[63] Continuation-in-part of Ser. No. 703,780, May 22, 1991, Pat. No. 5,174,513.

[51] Int. Cl.[5] ..... B02C 13/09

[52] U.S. Cl. ..... 241/48; 241/275

[58] Field of Search ..... 241/275, 299, 48

[56] References Cited

U.S. PATENT DOCUMENTS 3,162,382 12/1964 Danyluke ..... 241/275 X
4,373,679 2/1983 Kawano et al. ..... 241/275
4,641,787 2/1987 Peterson et al. ..... 241/275 X

*Primary Examiner*—Douglas D. Watts

*Attorney, Agent, or Firm*—Chernoff, Vilhauer

[57] ABSTRACT

A centrifugal impact crusher has an enclosed table to ensure that substantially all the material deposited on the table is impacted against the anvils that surround the table. The table includes spaced-apart upper and lower plates that have radially oriented impellers sandwiched between them to direct material being thrown off of the table by centrifugal force to exit the table at the proper angle to achieve maximum fracture upon striking the anvils. The impellers have projecting tabs which fit into receptacles in the upper and lower plates and the plates are squeezed together to hold the tabs in the receptacles and lock the plates and impellers together in a rigid table assembly. The upper plate has a central opening through which material is deposited onto the table. A funnel directs material fed into the crusher through an infeed plenum and into the central opening in the upper plate to ensure that all of the material reaches the table. Recirculation plenums extend from an outlet plenum located below the table up to the infeed plenum. The rotating table acts as a fan which draws air into the infeed tube along with the material, and this airflow creates a pressure differential across the table that causes air to flow through the recirculation plenum. The recirculation air includes dust and particulate matter which is either sent back through the crusher to be more finely crushed or is removed by filters.

16 Claims, 3 Drawing Sheets

EFFICIENT CENTRIFUGAL IMPACT CRUSHER WITH DUST REMOVAL CAPABILITY AND METHOD OF USING SAME

RELATED APPLICATIONS

This is a continuation-in-part of application Ser. No. 07/703,780 filed May 22, 1991, now U.S. Pat. No. 5,174,513.

BACKGROUND AND SUMMARY OF THE INVENTION

This invention relates to a centrifugal impact crusher, and in particular to such a crusher in which 100% of the material fed into the crusher is impacted against the crushing anvils and in which the amount of dust is significantly reduced.

Centrifugal impact crushers have successfully been used for crushing a wide range of materials. A use that has recently been suggested for centrifugal impact crushers is in the production of cement. Cement has traditionally been ground from clinker in ball mills using a two-step process. The clinker is first rough ground in a first section of the ball mill having large balls, and the ground material from the first section is then reground in a second section having smaller balls. When ball mills are used to grind large particles, such as occur with clinker, they consume excessive amounts of energy, and thus they are not well-suited for this purpose. German patent DE3815217 using a centrifugal impact crusher for the first section in crushing clinker, since centrifugal impact crushers handle material of this size much more efficiently than ball mills. However, the smaller second stage ball mill required to grind fine enough to produce cement does not handle large material well and the first stage device must reduce all of the material passing through it in the required amount. Prior art centrifugal impact crushers were designed to crush materials such as rock where a wide size range of crushed material is not only allowable, but actually desired. A substantial amount of material deposited onto the rotating table of prior art centrifugal impact crushers does not even strike the crushing anvils and thus is uncrushed. This means that when centrifugal impact crushers are used for the first stage of clinker reduction, the material must be sorted and a portion of it reground which increases the cost of using centrifugal impact crushers for clinker. Furthermore, cement creates tremendous amounts of dust when it is crushed in the violent manner that exists in a centrifugal impact crusher, and this dust creates significant problems.

While complete reduction and dust handling are critical when crushing clinker, dust creates problems when other materials are crushed as well. In many materials dust is handled by wetting the material. While wetting is obviously unworkable with cement, water makes sorting of other materials more difficult and it increases wear. In addition, when rock is crushed to sand, it is important that dust be separated from the sand and this cannot be done when the material is wetted during crushing.

The foregoing shortcomings and limitations of prior art centrifugal impact crushers are overcome in the subject invention by providing a table having spaced-apart upper and lower plates that have impeller blades sandwiched between them. The upper plate has a central opening through which material is deposited onto the table. Thus, the table is enclosed which forces substantially all of the material thrown off of it by centrifugal force to be impacted against the anvils. In addition, an annular retainer plate fits above the anvils and extends radially inward to the periphery of the upper plate. The retainer plate covers what little area there is for material that is thrown off of the enclosed table to miss the anvils.

The impellers have tabs protruding from their upper and lower surfaces which fit in conforming receptacles located in the upper and lower plates. The upper and lower plates are joined to one another by bolts or pins, and when the bolts are tightened or wedges inserted into the pins the tabs are seated in the receptacles and the plates and impellers form a rigid table assembly. The tabs cover a substantial portion of the impellers and, as a result, impeller attachment is spread over a large surface area which prevents the impeller connector breakage that is common with devices of this type due to the centrifugal force created by the high rotational speed and due to material striking the impellers.

In order to reduce dust and ensure uniform fine crushing, recirculation plenums extend from an outlet plenum at the bottom of the crusher shell to an infeed plenum through which material is fed into the crusher. The rotating table in the crusher acts as a fan which creates a negative pressure above the table and a positive pressure below the table. This pressure differential between the infeed plenum above the table and the outlet plenum below the table draws air into the recirculation plenums. Since the recirculation plenums receive air from beneath the table, dust and particulate matter resulting from the crushing is entrained in the air and this material passes through the recirculation plenums and back into the crusher. The recirculation plenums have first ports in them which permit particle-laden air to be removed from the plenums and the particles removed by filters or separators if desired. In addition, there are second ports in the recirculation plenums that permit specified amounts of graded material to be introduced into the crusher to insure crushed material of a particular size, or permit the addition of heated or moisture-laden air into the crusher. A flow restrictor located above the infeed plenum restricts the air that enters the crusher with the material in order to establish significant flow through the recirculation plenums. The infeed plenum is connected to the central opening in the upper plate of the table so that all of the material and dust-laden air in the infeed plenum reaches the table.

Accordingly, it is a principal object of the subject invention to provide a centrifugal impact crusher in which 100% of the material deposited in the device is thrown off of the table and impacted against the crushing anvils.

It is a further object of the subject invention to provide such a device in which the table is enclosed.

It is a still further object of the subject invention to provide such a device having a retaining plate over the anvils which prevents material from passing over them.

It is a still further object of the subject invention to provide a centrifugal impact crusher having an air recirculation system that recirculates air and entrained particles from the bottom of the crusher back into the infeed plenum.

It is a yet further object of the subject invention to provide such a crusher in which the air and entrained particles in the recirculation system can be filtered to remove the particles.

It is a still further object of the subject invention to provide such a crusher in which it is possible to regulate the amount of air that is drawn into the crusher with the material being crushed.

It is a further object of the subject invention to provide such a crusher in which particulate matter, heated air or moisture-laden air can be introduced into the recirculation system.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENTS

Figure 1:
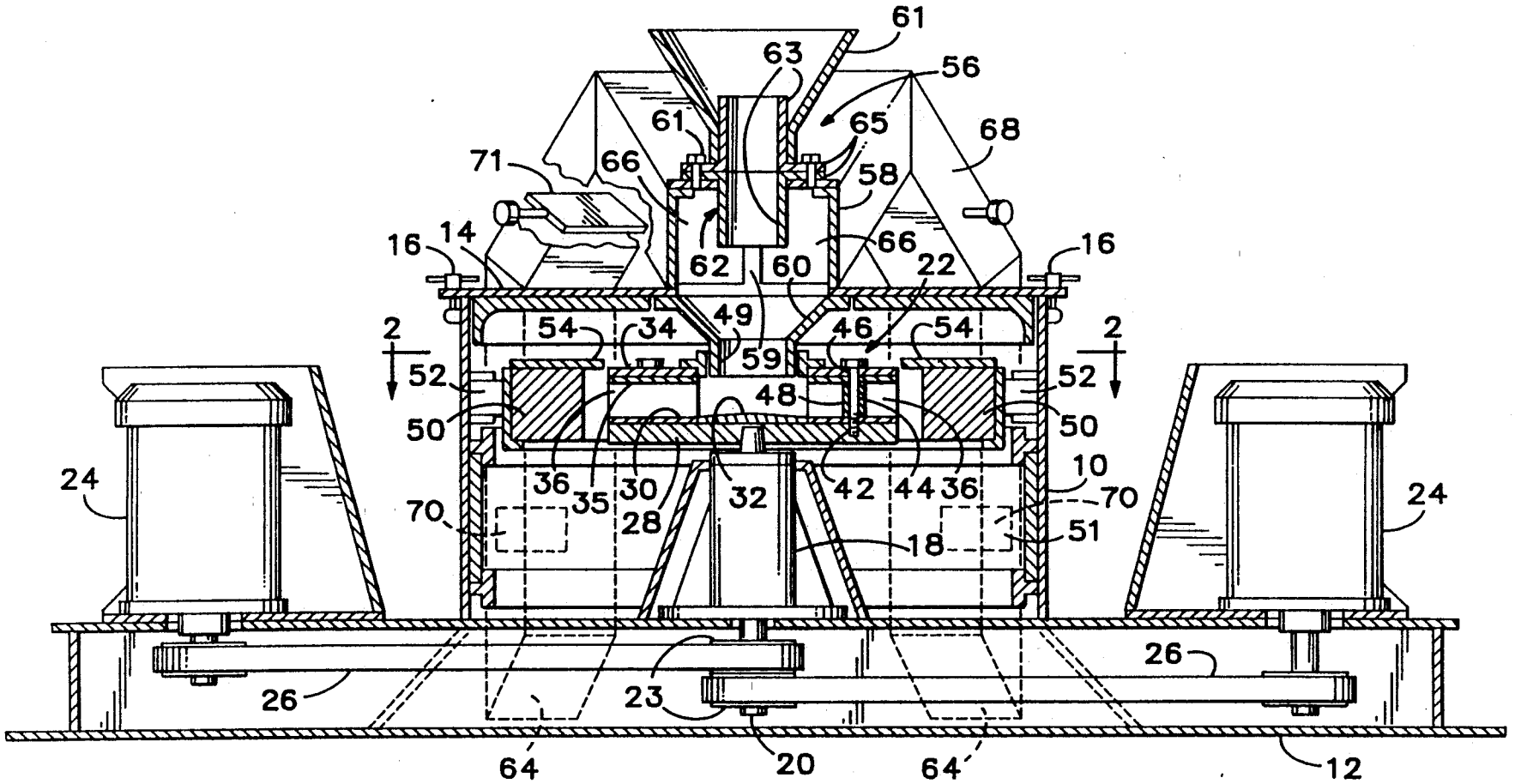
FIG. 1 is a side elevation view, in cross section, of a centrifugal impact rock crusher embodying the features of the subject invention.

Referring to FIG. 1 of the drawings, a crusher comprises a cylindrical shell 10 that is mounted on a rectangular frame 12. The shell is covered by a lid 14 that is releasably secured to the shell by means of locks 16. Located medially in the shell is a pedestal 18 that rotatably journals a shaft 20 having a table assembly 22 mounted on its upper end. The lower end of the shaft 20 carries a pair of pulleys 23 that are driven by electric motors 24 through belts 26. The table assembly 22 includes a flat circular lower plate 28 that is attached to the shaft 20 and is covered with a replaceable wear-resistant liner 30. The center section of the liner is in the shape of a cone 32. An upper plate 34 is attached to the lower plate and a plurality of radially oriented impellers 36 are sandwiched between them. The lower surface of the upper plate is covered with a replaceable wear-resistant liner 35.

Figure 2:
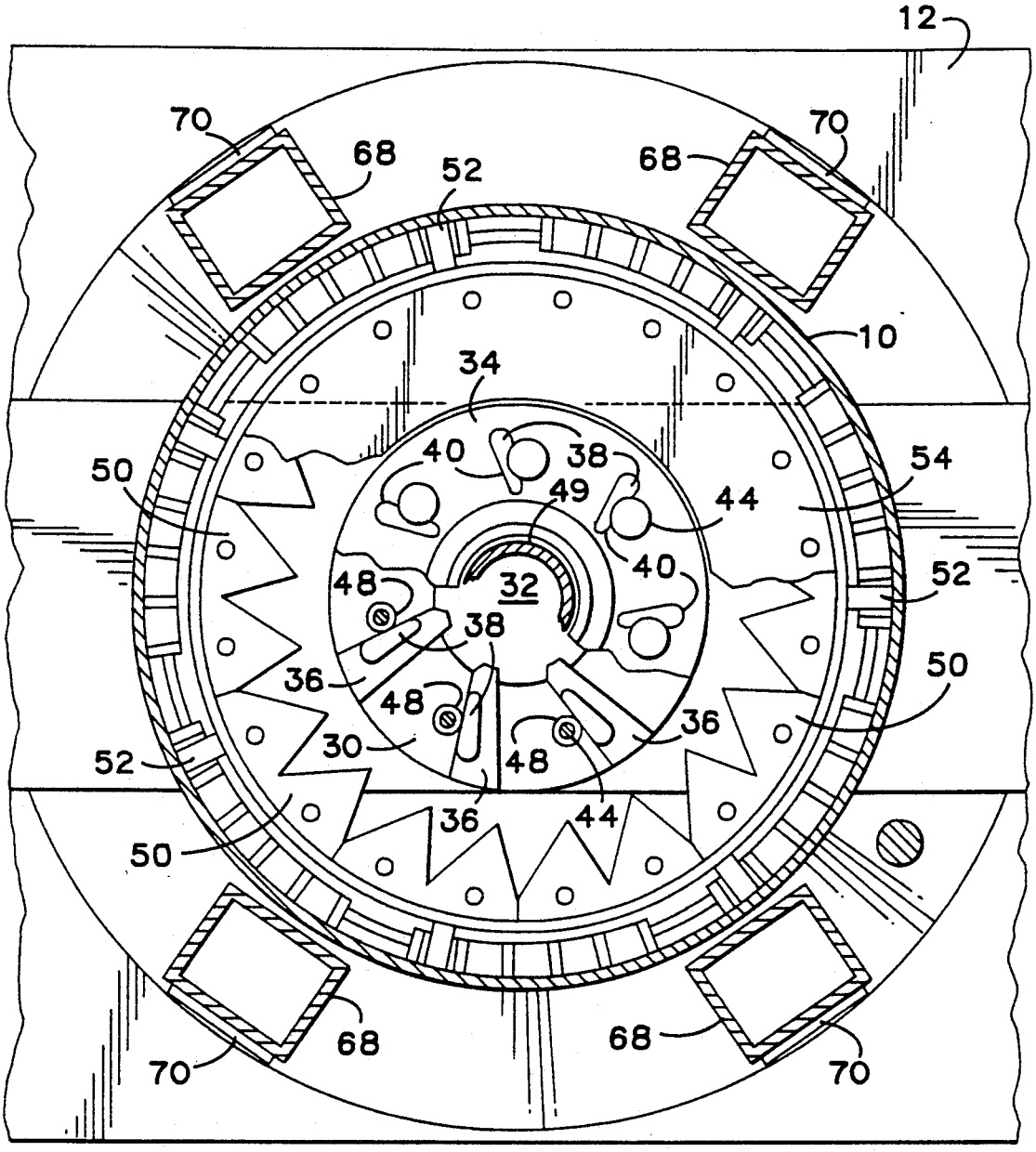
FIG. 2 is a sectional view taken along the line 2—2 in FIG. I, partially broken away to show hidden detail.
Figure 4:
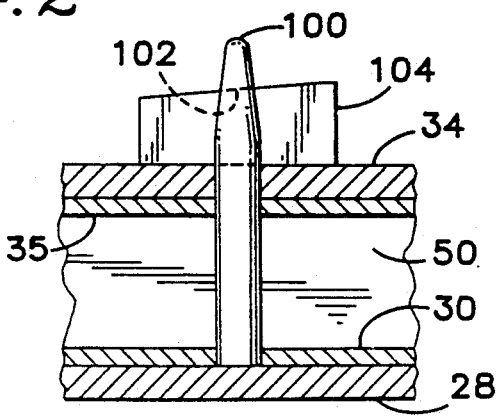
FIG. 4 is a detail view of an alternate embodiment of a portion of the crusher.
Figure 3:
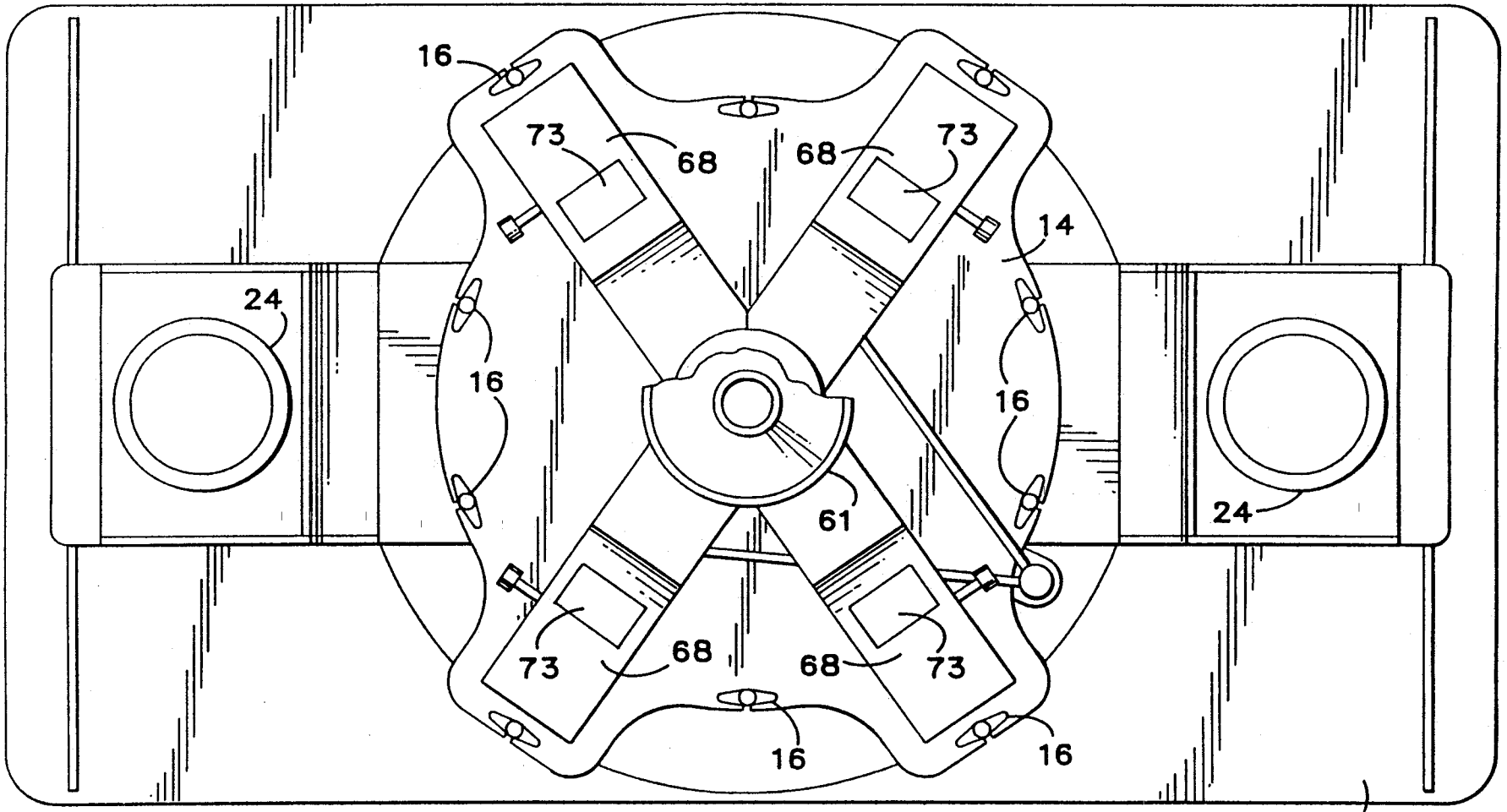
FIG. 3 is a plan view of the crusher of FIG. 1.

Referring now also to FIG. 2, the impellers 36 have tabs 38 protruding from their top and bottom surfaces, and the top and bottom plates have receptacles 40 in them which matingly receive the tabs. In one embodiment, shown in FIG. 1, the lower plate has threaded openings 42 located in it that receive bolts 44 that extend through aligned openings 46 in the upper plate. Thus, when the bolts are tightened, the plates are pulled together and the impellers are secured between them. In another embodiment, shown in FIG. 4, the bolts are replaced with pins 100 having slots 102 at their extremities and the nuts are replaced by wedges 104. The tabs constitute a relatively large percentage of the impellers thereby creating a strong bond between the impellers and plates that will not easily break during operation of the crusher, even when it is operated at high rates of speed and large forces act on the impellers. The large size of the tabs is necessary since the tabs transfer the entire shear load between the impellers and the remainder of the table. Since the bolts 44 or pins 100 do not carry the bulk of the shear loads, but merely hold the assembly together, their location is not critical and they can be placed entirely in the shadow of the impellers so that they are not impacted by the material being crushed and thus will not be subject to extensive wear. In order to further protect the bolts or pins, they are covered by replaceable wear-resistant shields 48. The upper plate 34 has a central opening 49 through which material is deposited onto the lower plate 28.

Located around the periphery of the shell 10, coplanar with the table assembly, are a plurality of anvils 50 that material thrown off of the table assembly by centrifugal force is impacted against. The fractured material drops between the periphery of the table assembly 22 and the anvils into an outlet plenum 51 provided in the shell below the table assembly. Appropriate removal devices (not shown) remove the crushed material from the outlet plenum and out of the crusher. The anvils 50 and their mounting system 52 are conventional for centrifugal impact crushers. Mounted above the anvils is an annular retainer ring 54 that extends inwardly to approximately the outer periphery of the upper plate 34.

Figure 5:
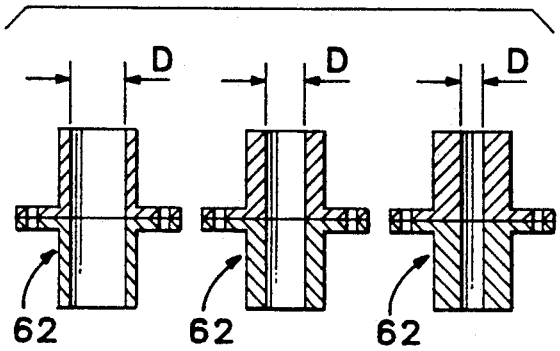
FIG. 5 is a side elevation view, in section of flow restrictors, which are elements of the invention.

Material is fed into the crusher through an infeed assembly 56 that is mounted on the lid 14. The infeed assembly includes a hollow cylindrical tube 58 that is attached to the lid and forms an infeed plenum 59. A funnel 60 extends from the bottom of the tube 58 into the opening 49 in the upper plate 34. Thus, all of the material passing through the infeed plenum 59 is directed into the table assembly. A hopper 61, located at the top of the crusher is connected to the tube 58 through a flow restrictor 62. In the preferred embodiment illustrated, the flow restrictor 62 includes a pair of back-to-back tube assemblies, each comprising a hollow tube 63 having a flange 65 at one end, which permits them to be joined together and to the tube 58 by means of bolts 67. Referring now also to FIG. 5, preferably there is a series of flow restrictors each having a different diameter "D" thereby permitting the flow restriction flow area to be changed as required.

Located around the bottom of the shell 10 is a set of openings 64 that open into the outlet plenum 51. A matching set of openings 66 located around the periphery of the tube 58 open into the infeed plenum 59. Each opening 64 is connected to a mating opening 66 through a recirculation plenum 68. A covered first port 70 is located in each recirculation plenum to permit a filtering system (not shown) to be connected to the plenums. An adjustable damper 71 is located in each recirculation plenum downstream of the first port 70. In addition, a covered second port 73 is located in each recirculation plenum downstream of the damper.

The crusher of the subject invention is operated like other centrifugal impact crushers, however, for several reasons provides improved performance. First, the enclosed table assembly 22 causes substantially all of the material deposited on it to be thrown radially outward such that it impacts the anvils 50 and becomes crushed. The retainer plate 54 covers the only area where material thrown off of the table could escape impacting the anvils, so that 100% of the material deposited on the table is crushed. In addition, the close connection between the infeed tube 58 and the upper plate 34 of the table assembly, created by the funnel 60, ensures that all material deposited in the hopper 61 at the top of the crusher is deposited on the table. Furthermore, the enclosed table assembly and close connection between the infeed tube and the table significantly reduces dispersion of the dust that is generated during crushing.

A much larger factor in the reduction of dust is the recirculation plenums 68. The rotating table assembly acts as a fan to draw air into the hopper 61 along with the material being crushed. Thus, a negative pressure is created above the table in the infeed plenum 59 and a positive pressure is created below the table in the outlet plenum 51. This pressure difference causes air to flow through the recirculation plenums 68 from the outlet plenum back into the infeed plenum. The flow restrictor 6 accelerates the air passing through the infeed plenum to create a venturi effect which increases the amount of air that flows through the recirculation plenums. The amount of this venturi effect can be adjusted as required by replacing the flow restrictor with one having a different flow area. Since the recirculated air has dust and particulate matter entrained in it, this material is passed back trough the crusher where it is crushed to a greater degree. If filters or separators are attached to the outlets 70, dust can be removed from all or a portion of the air entering the recirculation plenum. The relative amount of the recirculation air that is filtered depends upon the setting of the dampeners 71.

The dampers 71 can also be used to obtain the most efficient operation of the motor 24. As indicated above, the rotating table operates as a fan which draws air into crusher through the inlet plenum 58 and the recirculation plenum 68. The more air that is drawn through the crusher the more "pump work" that must be accomplished by the motor. Thus, when little or no recirculation is required, the damper can be partially closed to reduce the airflow to the minimum necessary level and thereby maximize the efficiency of the crusher.

In addition to recycling airborne particulate matter from the outlet plenum and removing particles through filtration, the recirculation plenums can be utilized to add particulate matter or alter the moisture content of the material being crushed. This is accomplished by introducing particulate matter, heated air or moisture laden air into the first port 70. The process can be implemented in a number of different ways. If the crusher is being used to crush clinkers prior to introduction into a ball mill, the material fed into the ball mill must be within a specified size range which will not always be achievable by crushing in a single pass through a centrifugal impact crusher. To achieve such close control, the damper 71 is partially closed and a large portion of the particulate matter is diverted out of the recirculation plenums through the second port 70 where it is captured by filters. The captured material is then sorted by grade and selectively introduced back into the recirculation plenum through one of the first ports 73 such that the material that ultimately is discharged from the crusher falls within the desired size range. Alternatively, particulate matter can be introduced into the crusher through the first port to achieve the proper blend without removing material from the second port for filtering.

With some materials, such as clinker, it is important that moisture is minimized during crushing to prevent caking of the material. In this case dried or heated air can be introduced into the first port to compensate for moisture in the material itself or in the air drawn into the funnel 61 with the material. On the other hand, with other materials moisture is critical in the crushing process to reduce dust. In this event metered quantities of moisture-laden air can be introduced into the crusher through the first port.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A centrifugal impact crusher having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, an outlet plenum defined in the chamber below the table, and one or more recirculating plenums that extend between the outlet plenum and the infeed plenum, said crusher comprising:

(a) a flow restrictor, having a defined flow area, located in the infeed plenum upstream of said recirculation plenums; and (b) means for changing said flow area.

2. The crusher of claim 1 wherein said flow restrictor includes a series of hollow cylindrical tubes each having a different diameter, and said means for changing comprises:

(a) flanges associated with each of said tubes; and (b) means for releaseably attaching said flange to said infeed plenum.

3. A centrifugal impact crusher having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, an outlet plenum defined in the chamber below the table, and one or more recirculating plenums that extend between the outlet plenum and the infeed plenum, said crusher comprising:

(a) adjustable flow control dampers located in said recirculation plenums;

(b) first access ports defined in said recirculation plenums downstream of said flow control dampers; and (c) second access ports defined in said recirculation plenums upstream of said flow control dampers.

4. A table for a centrifugal impact crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the tables substantially coplanar with the upper surface thereof, an outlet plenum defined in the chamber below the table, and one or more recirculating plenums that extend between the outlet plenum and the infeed plenum, said table comprising:

(a) a lower plate;

(b) an upper plate that overlies said lower plate and defines a central opening that communicates with the infeed plenum;

(c) upwardly and downwardly projecting tabs on said impeller blades:

(d) said upper and lower plates defining receptacles for receiving said tabs;

(e) one of said upper and lower plates a plurality of threaded holes defined therein;

(f) the other of said upper and lower plates having a plurality of openings defined therein with one of said openings being aligned with each of said holes;

(g) threaded fasteners that extend through said openings and into threaded engagement with said holes; wherein (h) said openings and holes being located in said plates such that said fasteners are located in the shadow of the impeller blades and not be contacted by material being crushed.

5. A method for crushing material in a centrifugal impact crusher of the type having an enclosed chamber, an infeed plenum that opens into the chamber and through which particulate matter is introduced into the crusher, and rotating table having a series of radially arrayed impeller blades on its upper surface located in the chamber below said infeed plenum, a plurality of anvils located in the chamber around the periphery of the table substantially coplanar with the upper surface thereof, an outlet plenum defined in the chamber below the table, and one or more recirculation plenums that extend between the outlet plenum and the infeed plenum, said method comprising:

a. providing inlet ports in said recirculation plenums; and b. introducing additional particulate matter which has not previously passed through said infeed plenum into said inlet ports to increase the concentration of particulate matter in the air passing through said infeed plenum to a desired level.

6. A method for crushing material in a centrifugal impact crusher of the type having an enclosed chamber, an infeed plenum that opens into the chamber and through which particulate matter and air are introduced into the crusher, a rotating table having a series of radially arrayed impeller blades on its upper surface located in the chamber below said infeed plenum, a plurality of anvils located in the chamber around the periphery of the table substantially coplanar with the upper surface thereof; an outlet plenum defined in the chamber below the table into which particulate matter that is thrown off of said rotating table against said anvils and is fractured is urged by gravity and one or more recirculation plenums that extend between the outlet plenum and the infeed plenum through which is selected portion of fractured particulate matter is reintroduced into the infeed plenum, said method comprising:

a. providing inlet ports in said recirculation plenums; and b. introducing additional air, which did not pass through the crusher with the fractured particulate matter when it was initially fractured, into said inlet ports to decrease the concentration of particulate matter in the air passing through said infeed plenum to a desired level.

7. The method of claim 6, including the further step of heating said air before it is introduced into said inlet ports.

8. The method of claim 6, including the step of adding moisture to said air before it is introduced into said ports.

9. A method for crushing material in a centrifugal impact crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, an outlet plenum defined in the chamber below the table, and one or more recirculation plenums that extend between the outlet plenum and the infeed plenum, said method comprising:

a. providing adjustable flow control dampers in said recirculation plenums;

b. providing first access ports in said recirculation plenums downstream of said flow control dampers;

c. providing second access ports in said recirculation plenums upstream of said flow control dampers;

d. removing air and airborne particles from said second ports for processing said airborne particles;

e. introducing particulate matter into said first port.

10. The method of claim 9, including the step of introducing air into said first port.

11. The method of claim 10, including the step of heating said air before it is introduced into said first port.

12. The method of claim 10, including the step of adding moisture to said air before it is introduced into said first port.

13. A method for crushing material in a centrifugal impact crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof; an outlet plenum defined in the chamber below the table, and one or more recirculation plenums that extend between the outlet plenum and the infeed plenum, said method comprising:

a. providing adjustable flow control dampers in said recirculation plenums;

b. providing first access ports in said recirculation plenums downstream of said flow control dampers;

c. providing second access ports in said recirculation plenums upstream of said flow control dampers;

d. at least partially closing said dampers;

e. introducing air and particulate matter into said first port.

14. The method of claim 13, including the further step of heating said air before it is introduced into said inlet port.

15. The method of claim 13, including the step of adding moisture to said air before it is introduced into said inlet port.

16. A method of crushing material in a centrifugal impact crusher of the type having an enclosed chamber, an infeed plenum that opens into the chamber, a rotatable table having a series of radially arrayed impeller blades on its upper surface located in the chamber below said infeed plenum, a motor for rotating said table, a plurality of anvils located in the chamber around the periphery of the table substantially coplanar with the upper surface thereof, an outlet plenum defined in the chamber below the table and one or more recirculation plenums that extend between the outlet plenum and the infeed plenum, said method comprising:

a. providing adjustable flow control dampers in said recirculation plenums; and b. modulating the position of said dampers in a manner such that said motor operates at its maximum efficiency for the material being crushed and the desired table speed.

* * * * *